United States Patent [19]

Giessler

[11] 4,142,709

[45] Mar. 6, 1979

[54] HOIST

[75] Inventor: Willi Giessler, Winterthur-Wülflingen, Switzerland

[73] Assignee: Mifago AG, Liechtenstein

[21] Appl. No.: 861,341

[22] Filed: Dec. 16, 1977

[30] Foreign Application Priority Data

Dec. 20, 1976 [DE] Fed. Rep. of Germany ..... 2657768

[51] Int. Cl.[2] ..... B66D 1/00

[52] U.S. Cl. ..... 254/168; 254/189; 187/26

[58] Field of Search ..... 254/189, 168, 167, 188, 254/150 FH, 150 R, 186 R, 174; 187/26, 20; 251/353, 347, 349; 173/81, 147; 91/48, 449; 248/328, 332

[56] References Cited

U.S. PATENT DOCUMENTS 2,919,109 12/1959 Minty ..... 254/189

3,109,615 11/1963 Fritz ..... 254/150 FH 3,675,899 7/1972 McKendrick ..... 254/168

*Primary Examiner*—Trygve M. Blix

*Assistant Examiner*—Kenneth W. Noland

*Attorney, Agent, or Firm*—McGlew and Tuttle

[57] ABSTRACT

A hoist comprises a housing with a first pulley set of a plurality of pulleys rotatably mounted in the housing in a fixed location. A piston member which is in sealing engagement with the housing is movable backwardly and forwardly under the control of fluid pressure admitted to respective sides of the piston and it provides a mounting for a second set of pulleys. A cable or rope is guided around the pulleys of the first and second sets and the end of the cable is passed through the housing and has a lower load-carrying end. The drive is connected to move the piston mounting member backwardly or forwardly in respect to the first set of pulleys for the purpose of lowering or raising the load-carrying end of the rope.

5 Claims, 2 Drawing Figures

HOIST

FIELD AND BACKGROUND OF THE INVENTION

This invention relates to hoists in general and, in particular, to a new and useful hoist which consists of a block and tackle assembled in a cylinder-like housing and formed by two rope pulley sets which are adjustable relative to each other and are interconnected by a hoisting rope with one of the rope pulley sets being stationarily mounted while the outer set is assembled in a piston-like component, movable relative to the first set by a pressure medium.

DESCRIPTION OF THE PRIOR ART

Hoists of this type which are actuated by compressed air are already known and have also proven themselves. The component carrying the movable rope pulley set and the piston chargeable by compressed air, as well as the piston rods connecting them rigidly, are made in the known design in the form of a one-piece casting. The piston rods must therefore be led laterally past the intermediary part so that a seal between it and the housing accommodating the movable rope pulley set as well as the cylinder is impossible to accomplish. Since such hoists are used particularly in wet rooms, such as car washes, moisture and dirt gets into the hoist interior from both sides of the intermediary part. This makes the guideways of the moving parts subject to considerable wear and rapid corrosion so that breakdowns after a short operating time are almost unavoidable, and much maintenance time, associated with considerable costs are the result thereof. Furthermore, this known hoist design is bulky inasmuch as the cylinder and piston are arranged lateral to the block and tackle.

SUMMARY OF THE INVENTION

The present invention provides a hoist which omits the aforementioned disadvantages of the prior art. Moisture and dirt cannot penetrate the interior of the hoist even under extreme operating conditions so that the hoist is completely encapsulated and is thus free from trouble and requires no maintenance. In addition, the design is simple so as to make economical production possible, and the length of the assembly is extremely short.

According to the invention, the hoist comprises a block and tackle assembled in a cylinder-like housing and formed by two rope pulley sets which are adjustable relative to each other and are interconnected by a hoisting rope with one of the rope pulley sets being stationarily mounted while the other is assembled in a piston-like component movable relative to the first pulley by a pressure medium. Two rope pulley sets are accommodated in a closed housing consisting of a master cylinder with a pressure-tight lead-through for the hoisting rope. The component carrying the movable rope pulley set is the form of a piston guided pressure-tight in the master cylinder and being chargeable with the pressure medium on one or both sides.

It is expedient to accommodate the stationary rope pulley set in a flange designed as a cover of the master cylinder and to connect the two covers or flanges closing the master cylinder firmly to each other by means of tie rods extending alongside the master cylinder. It is further advisable to provide spacer rods on one or both members carrying the two rope pulley sets to limit their mutual spacing.

A hoist designed in accordance with the invention offers not only the advantages of the known pneumatically actuated design of a comparable kind, i.e., almost noiseless operation, no spark formation, infinitely variable control of the load lifting and lowering speed and little energy consumption but, in addition, it assures by its structural design that no moisture or dirt can penetrate the hoist interior. For, when the two rope pulley sets are accommodated in a closed housing consisting of a master cyliner and when the component carrying the movable rope pulley set designed as a piston, a self-contained assembly is created which is completely watertight, and the operating noise is reduced in addition.

Accordingly, breakdowns caused by the penetration of foreign matter are precluded and the hoist requires no maintenance because the lubricants for the moving parts applied during assembly remain in the assembly and are not flushed out. Due to the inventive construction, production and assembly costs are also reduced considerably, because guide rods and the intermediary parts required in the known designs are eliminated. In addition, the individual components do not have to be size-fitted to each other, thereby, simplifying production and reducing its costs, and since no oil drop formation occurs, the hoist according to the invention can be employed to advantage almost anywhere, particularly in the medical, food and chemical industries, and may possibly also be independent of an operating power supply network.

Accordingly, it is an object of the invention to provide a hoist construction which includes a first set of a plurality of rotatable pulleys arranged in a fixed location in the housing and a second set of plurality of pulleys rotatably mounted in a piston member which is slidable in the housing and which includes a cable trained to run from one set to the other over the pulleys and to extend through a sealed location of the housing and have a lower end for carrying a load and which also includes means for moving the piston member in the housing for raising the load-carrying end upwardly and downwardly.

A further object of the invention is to provide a hoist construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
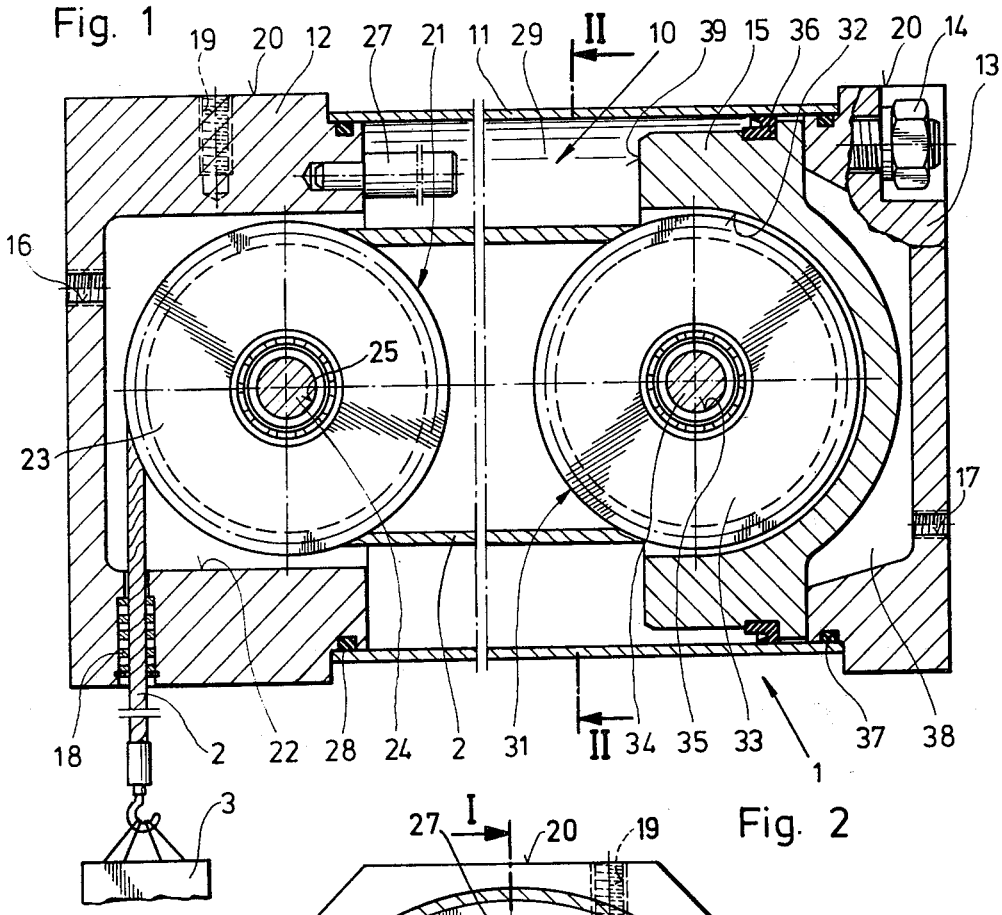
FIG. 1 is an axial sectional view of a hoist constructed in accordance with the invention.
Figure 2:
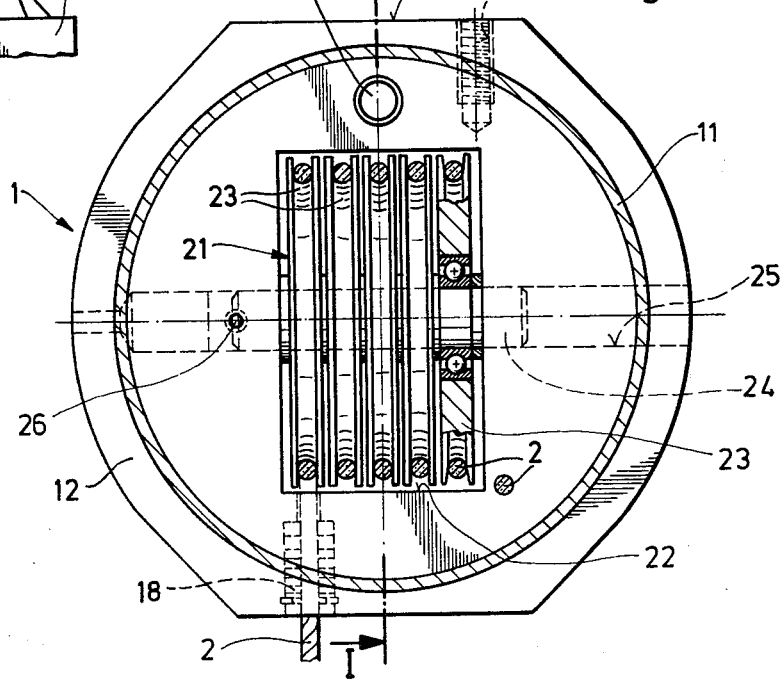
FIG. 2 is a section taken along the line 2—2 of FIG. 1.

Referring to the drawing in particular, the invention embodied therein, comprises a hoist in which the load 3 is raised and lowered by shifting a first set of pulleys 33 relative to a second set of pulleys 23 over which the rope is guided. The hoist 1, shown in FIG. 1 and intended to raise or lower a load 3 suspended from a hoisting rope 2, comprises a block and tackle 10 formed by two rope pulley sets 21 and 31, across whose pulleys 23 and 33 the hoisting rope 2 is led. The two rope pulley sets 21 and 31 forming the block and tackle 10 are disposed in a closed housing comprising a master cylinder 11 and the two flanges or close-ended cylinders 12 and 13 closing its respective ends. The flanges 12 and 13 are rigidly connected to each other by tie rods 14 led alongside the outside of cylinder 11.

The fixed rope pulley set 21 includes a plurality of parallelly arranged pulleys 23 which are rotatably mounted in the flange 12 which has a recess 22 for this purpose. The individual rope pulleys 23, across which the rope 2 is led, are rotatably mounted on a shaft 24 inserted in a hole 25 in flange 12 and retained by a threaded pin 26. The adjustable pulley sets of a plurality of parallel rope pulleys 33 are mounted on a structural member 15 of piston-like design, and also have a recess 32 with bearing holes 35, 35 to receive a rope pulley mounting shaft 34.

Piston 15 guided in cylinder 11 carries a seal ring 36 inserted in a groove of the piston so as to rest against the inside wall of cylinder 11. The piston 15 divides the interior into two pressure chambers 29 and 38 to which a pressure medium can be supplied alternately through the inlets 16 and 17, respectively. The joints between the cylinder 11 and the flanges 12 and 13 are sealed by seals 28 and 37, respectively, and the lead-through 18 for the hoisting rope 2 through flange 13 is also sealed. The hoist 1 is capable of being suspended from a rail or the like adjacent to the surfaces 20, 20' by holding means (not shown) screwed into the tapped holes 19.

When a pressure medium is supplied to the pressure chamber 29 through the inlet 16, pressure will build up in it, and piston 15, including the rope pulley set 31 rigidly jointed to it, will be moved to the right. At the same time, the pressure chamber 38 will be vented through the connection 17. Thus, the load suspended from rope 2 is raised due to this motion of piston 15. The load 3 can be lowered either by its own weight or by venting the pressure chamber 29, but it is also possible to introduce pressure medium to the pressure chamber 38. In order that the pulleys 23 and 33 will not make mutual contact during the return of piston 15, spacer rods 27, supported by the bearing surface 39 of piston 15, are inserted in the flange 12.

The hoist 1 is thus a self-contained unit which needs no maintenance, cannot be penetrated by moisture and dirt and can be employed in many ways. Inasmuch as an infinitely variable control of the load lifting and lowering speed is easily installed, almost no operating noise develops and no sparks form at low energy consumption.

While a specific embodiment of the invention has been shown and described in detail to illustrate the application of the principles of the invention, it will be understood that the invention may be embodied otherwise without departing from such principles.

What is claimed is:

1. A hoist, comprising a housing, a first pulley set comprising a plurality of first pulleys rotatably mounted in said housing at a fixed location in said housing, a piston mounting member in said housing in sealing engagement with the walls thereof, a second pulley set of a plurality of second pulleys rotatably mounted in said piston mounting member, a rope trained around the pulleys of said first and second pulley sets and having a load-carrying end extending out of said housing, and drive means connected to said piston mounting member to move said piston mounting member backwardly and forwardly in said housing relative to said first set of pulleys to raise and lower the load-carrying end of said rope, said housing having a wall with a pressure-tight lead therethrough, said rope extending through said pressure-tight lead from said second set of pulleys.

2. A hoist, as claimed in claim 1, wherein said housing includes a cylindrical flange member covering one end thereof, said first set of pulleys being rotatably mounted in said flange member.

3. A hoist, as claimed in claim 1, wherein said housing comprises a master cylinder with respective first and second flanges closing each end thereof and a tie rod extending through said flanges and holding them firmly together.

4. A hoist, as claimed in claim 1, including means for limiting the movement of said piston mounting member.

5. A hoist, as claimed in claim 4, wherein said means for limiting movement of said piston mounting member includes a flange member closing one end of said housing and carrying said stationary set of pulleys and a spacer rod connected to said flange member and projecting outwardly therefrom toward said piston mounting member.

* * * * *